US012624934B2

(12) United States Patent
Graf et al.

(10) Patent No.: US 12,624,934 B2
(45) Date of Patent: May 12, 2026

(54) HAND-THROWABLE EFFECT-PRODUCING BODY WITH A MANUALLY GRASPABLE HOUSING BODY AND METHOD FOR OPERATING A HAND-THROWABLE EFFECT-PRODUCING BODY

(71) Applicant: Rheinmetall Waffe Munition ARGES GmbH, Schwanenstadt (AT)

(72) Inventors: Helge Graf, Schwanenstadt (AT); Rene Huber, Rüstorf (AT)

(73) Assignee: Rheinmetall Waffe Munition Arges GmbH, Schwanenstadt (AT)

( * ) Notice: Subject to any disclaimer, the term of this patent is extended or adjusted under 35 U.S.C. 154(b) by 0 days.

(21) Appl. No.: 19/009,921

(22) Filed: Jan. 4, 2025

(65) Prior Publication Data

US 2025/0137765 A1 May 1, 2025

Related U.S. Application Data

(63) Continuation of application No. PCT/EP2023/068251, filed on Jul. 3, 2023.

(30) Foreign Application Priority Data

Jul. 4, 2022 (DE) ..... 102022116662.7

(51) Int. Cl.
*F42B 27/00* (2006.01)
*F42C 9/10* (2006.01)
*F42C 14/02* (2006.01)

(52) U.S. Cl.
CPC ..... *F42B 27/00* (2013.01); *F42C 9/10* (2013.01); *F42C 14/02* (2013.01)

(58) Field of Classification Search
CPC .. F42B 27/00; F42B 27/08; F42B 8/26; F42C 9/10; F42C 14/02
See application file for complete search history.

(56) References Cited

U.S. PATENT DOCUMENTS 1,560,628 A * 11/1925 Wiley ..... F42B 27/00 102/487
1,897,992 A 2/1933 Ailes
(Continued)

FOREIGN PATENT DOCUMENTS

CH 426556 A * 12/1966 ..... F42C 15/31
DE 948039 C 8/1956
(Continued)

OTHER PUBLICATIONS

International Search Report dated Oct. 6, 2023 in corresponding application PCT/EP2023/068251.
(Continued)

*Primary Examiner* — Gabriel J. Klein
(74) *Attorney, Agent, or Firm* — Muncy, Geissler, Olds & Lowe, P.C.

(57) ABSTRACT

A hand-throwable effect-producing body with a manually graspable housing body, a manually operable triggering device having a spring-loaded impact body, an ignition device initiatable by the triggering device and comprises an ignition charge, a delay device is initiatable by the ignition device and comprises a delay charge and a delay line, and a main charge configured to be initiated directly or indirectly by the delay charge. The impact body is configured to be manually moved along the longitudinal axis thereof counter to a spring force into a preloaded position and to be releasably arrested there and to be released by manually operating a triggering element of the triggering device, such that it can shoot out of its preloaded position along the longitudinal axis against an axial stop and thereby initiate the ignition charge.

22 Claims, 5 Drawing Sheets

(56) References Cited

U.S. PATENT DOCUMENTS

| | | | | | |
|---|---|---|---|---|---|
| 2,737,116 | A * | 3/1956 | Manzolini | F42B 27/00 | 102/487 |
| 3,498,223 | A * | 3/1970 | Andersson | F42C 15/20 | 102/221 |
| 3,742,855 | A * | 7/1973 | Webb | F42C 14/02 | 102/261 |
| 2012/0288830 | A1 | 11/2012 | Van Zuilen et al. | | |
| 2020/0309493 | A1* | 10/2020 | Wustlich | F42B 12/36 | |
| 2025/0052551 | A1* | 2/2025 | Graber | F42B 12/36 | |

FOREIGN PATENT DOCUMENTS

| | | | | | |
|---|---|---|---|---|---|
| DE | 2031940 | A1 * | 1/1971 | | |
| FR | 491522 | A * | 6/1919 | | |
| FR | 2437607 | A1 | 4/1980 | | |
| FR | 3037644 | A1 * | 12/2016 | F42C 14/02 | |
| NO | 118312 | B * | 12/1969 | F42B 8/26 | |

OTHER PUBLICATIONS

Inetres.com "Gary's U.S. Infantry Weapons Reference Guide. Hand Grenades: C12integral fuze" available at https://www.inetres.com/gp/military/infantry/grenade/hand.html Mar. 23, 2023.

* cited by examiner

HAND-THROWABLE EFFECT-PRODUCING BODY WITH A MANUALLY GRASPABLE HOUSING BODY AND METHOD FOR OPERATING A HAND-THROWABLE EFFECT-PRODUCING BODY

This nonprovisional application is a continuation of International Application No. PCT/EP2023/068251 filed on Jul. 3, 2023, which claims priority to German Patent Application No. 10 2022 116 662.7, which was filed in Germany on Jul. 4, 2022, and which are both herein incorporated by reference.

BACKGROUND OF THE INVENTION

Field of the Invention

The present invention relates to a hand-throwable effect-producing body with a manually graspable housing body, a manually operable triggering device with a spring-loaded impact body, with an ignition device which is initiatable by the triggering device and comprises an ignition charge, with a delay device, which is initiatable by the ignition device and comprises a delay charge and a delay line, and with a main charge which is initiatable directly or indirectly by the delay charge.

Description of the Background Art

The invention therefore relates to an effect-producing body which is manually triggered or initiated and then manually thrown away by the user. In particular, it can be a hand grenade or a decoy. Accordingly, the main charge includes an explosive charge or another pyrotechnic main charge. It should be mentioned that the term "initiate" is chosen and used throughout the present application to refer to any type of ignition or detonation or the triggering of a combustion or actioning of a pyrotechnic charge or explosive charge of whatever type.

Effect-producing bodies of the type mentioned above usually have so-called rocker arm triggering devices, which have thus far become established for cylindrical designs. These systems usually include a safety pin with a ring that can be grasped and pulled by the user's finger, a safety clip and a preloaded striker spring, with the safety clip holding the striker spring in its preloaded state when in a position secured by the safety pin. When the safety pin is pulled out, the safety clip can swing away under the action of the preloaded striker spring, and the striker spring can then initiate the ignition device or its ignition charge as an impact body or by means of an impact body. The delay device connected thereto, with its delay charge, gives the user sufficient time to throw the grenade. US 2012/0288830 A1 discloses an effect-producing body which, however, does not comprise a pyrotechnic delay charge but has a mechanically implemented delay device by means of which a pivoting movement of a rocker arm is delayed. In a previously known non-lethal hand grenade of the type ABC-M25A2, a firing pin comprising an ignition charge is under permanent spring force even before the intended use and is secured by a safety pin with a pull ring. U.S. Pat. No. 1,897,992 describes a rod-like effect-producing body for the emission of irritant gases, in which a manually tensionable and triggerable striking mechanism for igniting the emitted gas is provided in a handle portion.

Preloaded striker springs are generally installed in other triggering devices known thus far, which is naturally complex and potentially also risky. Furthermore, once the safety pin has been pulled out, it is no longer possible to secure the triggering device again. Grasping and pulling out the safety pin does not usually allow one-handed operation either. Furthermore, the triggering device represents an additional component to the ignition device and delay device.

SUMMARY OF THE INVENTIONS

It is therefore an object of the present invention is to provide a more compact design. In further developments of the invention, more of the disadvantages described above are also to be avoided.

In a hand-throwable effect-producing grenade according to an example of the invention, the object is achieved in that the spring-loaded impact body can comprise the ignition device together with the ignition charge and the delay device together with the delay charge and together with the delay line, and that the impact body is manually movable along the longitudinal axis thereof counter to a spring force into a loaded position and is releasably arrestable there and can be released by manually operating a triggering element of the triggering device such that it can shoot out of its preloaded position along the longitudinal axis against an axial stop and thereby set off the ignition charge.

According to an example of the invention, it is therefore proposed to refrain from the use mentioned at the outset of a safety pin having a ring and safety clip as well as a preloaded striker spring and instead to design the triggering device in such a way that the impact body can only be manually moved into a preloaded position and releasably arrested therein when this is necessary. No separate impact body is provided either, but the impact body simultaneously also accommodates and includes the ignition device and the delay device. Unlike in the prior art, a separate impact body is thus not accelerated against a ignition device, usually in the form of a so-called primer, but the ignition device and the delay device to an extent form the impact body and are thrown against an axial stop, which can also be referred to as an anvil, thus initiating the ignition charge. In a development of the invention, it has proven to be advantageous if the impact body is sleeve-shaped at least in portions and forms a receiving space for the ignition device and the delay device. In this way, the ignition charge and the delay charge can be connected to one another to an extent and accommodated in the receiving space formed by the sleeve-shaped impact body.

The impact body, which can move along its longitudinal axis, can be accommodated in any desired manner per se within the housing body so that it can move longitudinally. However, in a development of this concept, it has proven to be advantageous if the impact body is guided within a helical spring along the longitudinal axis so as to move longitudinally, wherein the helical spring is axially directly or indirectly supported against the housing body at one end with respect to the longitudinal axis.

Furthermore, it has proven to be advantageous if the helical spring is connected at the other end to the impact body or is supported against the impact body in the direction of the longitudinal axis, in particular is supported against a radial projection of the impact body. In this way, an arrangement of the spring and the impact body within the housing body that saves space in the longitudinal direction can be realized. The above-mentioned radial projection of the impact body can be formed, for example, by an outer step, an annular collar or a pin-shaped projection or the like.

The triggering device can comprise a manually grippable tensioning element, by means of which the impact body is movable into its preloaded position.

This tensioning element can be formed by the impact body itself, in particular by its outer surface or by a laterally projecting region of the impact body. However, it can also be a separate, manually grippable tensioning element which is drivingly connected to the impact body in the direction of the longitudinal axis.

The manually grippable tensioning element can be pivotable about the longitudinal axis with respect to the housing body and in particular also with respect to the impact body. The pivotable arrangement of the tensioning element makes it possible to provide additional functionalities or to move the tensioning element from an actuable position to a non-actuable position in a single adjustment process, for example by means of the user's thumb.

Furthermore, it has proven to be advantageous if the manually grippable tensioning element is movable back and forth between a securing position and a tensioning position, and when the impact body is held at a distance from the axial stop in the direction of the longitudinal axis when the manually grippable tensioning element is in the securing position, and when the impact body is movable back and forth in the direction of the longitudinal axis when the manually grippable tensioning element is in the tensioning position. When the tensioning element is in the securing position, this also ensures that the impact body cannot accidentally strike the axial stop and thereby initiate the ignition device. The tensioning element therefore performs both a tensioning function and a securing function.

Following the tensioning process, it is advantageously provided that the impact body is releasably lockable in its preloaded position by a spring-loaded locking member interlockingly engaging behind the impact body in the direction of the longitudinal axis. This allows the impact body to be kept in its preloaded state. The interlocking engagement behind the impact body in the longitudinal direction means that any locking member per se engages, transversely to the longitudinal direction, in a region of the impact body behind which it is possible to engage.

The spring-loaded locking member can be movable linearly back and forth transversely to the longitudinal axis and has a through-opening extending in the direction of the longitudinal axis, through which the impact body is movable when the locking member is in a position in which the through-opening of the locking member is aligned with the longitudinal axis of the impact body.

This design enables the locking member to be guided and supported on both sides of the impact body, which facilitates the absorption of resulting forces and their even dissipation in the housing body such that jamming of the components can be prevented more effectively.

The spring-loaded locking member can be designed in the shape of a piston, rod or shaft portion and is accommodated in the housing body so as to be movably guided transversely to the longitudinal axis.

The spring-loaded locking member can have a constriction around the outer circumference, which forms an insertion bevel for the impact body in the direction of the through-opening.

The manually operable triggering element of the triggering device can simultaneously form the spring-loaded locking member. This additional measure also makes it possible to achieve a compact design by reducing the number of parts.

The triggering element of the triggering device should be located next to the housing body so that it is easy to grasp. It has proven to be advantageous if the spring-loaded locking member projects outward beyond the housing body by a free end when in its position in which it locks the impact body.

The effect-producing body can be designed in such a way that the housing body thereof is substantially cuboid and flat and comprises a first direction and a second direction and a third direction which are orthogonal to one another and extend along or in parallel with corresponding edges of the housing body, wherein the first direction runs along the longitudinal axis of the impact body, and wherein the dimension of the housing body in the first direction is larger than in the second and third directions and preferably the dimension of the housing body in the second direction is larger than in the third direction, and that the housing body delimits a first and a second receiving space, both of which extend in the first direction and are arranged next to one another in the second direction, and that the manually operable triggering device together with the ignition device and delay device are accommodated in the first receiving space and that the main charge is accommodated in the second receiving space. The design of the housing body as a preferably flat, cuboid housing body has proven to be advantageous because the effect-producing body can then be held in a user's hand with a good feel to it and can thereby be actuated.

The first and the second receiving space can be separated from one another by a wall extending in the first direction, wherein the wall is thin or has openings so that ignition transfer from the delay charge to the main charge is possible through the wall.

With this cuboid design of the housing body, the manually grippable tensioning element can protrude outward beyond the housing body in the second direction when in its securing position.

In such a case, the tensioning element can be arranged in such a way that the user can operate it with their thumb and move it from the securing position to the tensioning position, and vice versa.

The manually grippable tensioning element can be pivotable from its securing position into its tensioning position and, in the tensioning position, protrudes outward beyond the housing body in the third direction. In particular, it is possible and has therefore proven to be advantageous for the tensioning element and the triggering element of the triggering device to be arranged on the housing body in such a way that one-handed operation of the effect-producing body is possible, in particular for preloading the impact body and for actuating the triggering device.

Furthermore, the spring-loaded locking member can project outward beyond the housing body in the second direction when in its position in which it locks the impact body. In particular, it can be arranged in such a way that the user can press the locking member back into the housing body using a finger.

Further a method is provided, which has proven to be advantageous because it allows the effect-producing body to be operated with one hand.

For this purpose, it has also proven advantageous if the tensioning element is moved from its securing position into its tensioning position, in particular is pivoted, in particular and preferably by means of the thumb of the user's hand that is holding the effect-producing body. With the same or another finger of the same hand, the user can then actuate the triggering device so that the tensioned impact body shoots out against a stop and initiates the ignition.

In a further design, it is proposed that, in order to releasably arrest the impact body in its preloaded position, a spring-loaded locking member is automatically moved into a position that locks the impact body along the longitudinal axis when the impact body is tensioned.

The locking member can protrude from the housing body in the position in which the impact body is locked and is pressed back into the housing body as a triggering element in order to release the impact body.

The impact body together with the spring can be accommodated in a guide housing body that can be inserted into the housing body so that it can move longitudinally and to be insertable into the housing body together with said guide housing body. In this way, a prefabricated unit comprising the components of the manually operable triggering device comprising the impact body, triggering device and ignition device and delay device can be provided and inserted into the housing body.

The subject matter of the method according to the invention also includes all measures with method-related content that have previously been explained in connection with the structural design of the effect-producing body.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 2:
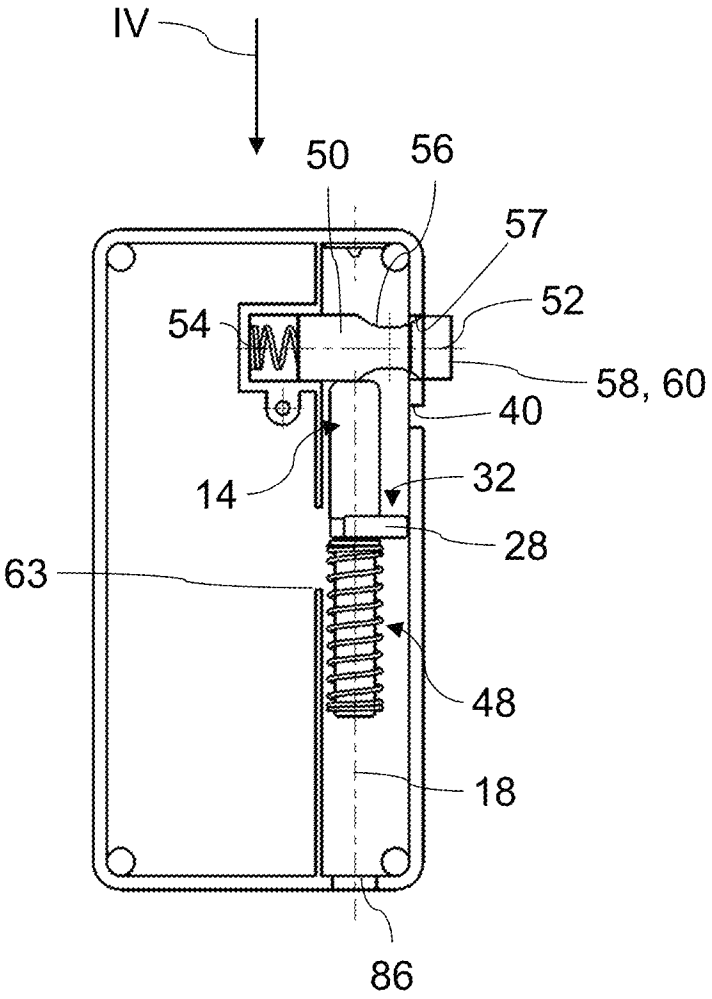
FIG. 2 is a view corresponding to FIG. 1 in a loaded and releasably arrested state of the impact body.

The drawings show various views of a hand-throwable effect-producing body according to the invention, which is designated as a whole by reference sign 2. The effect-producing body 2 comprises a housing body 4 that is, by way of example and preferably, flat, in particular cuboid. Furthermore, the effect-producing body 2 comprises a manually operable triggering device 6, which is accommodated in a first receiving space 8 of the housing body 4. A main charge 12 is accommodated in an adjacent second receiving space 10, which charge is ultimately initiatable with a delay in a manner still to be explained below and which is, for example, an explosive charge or another pyrotechnic main charge, as is used in particular in decoys.

The triggering device 6 includes a spring-loaded impact body 14 which, in the example and preferred case shown, is preloaded by a helical spring 16 and at the same time is guided in the first receiving space 8 so as to move longitudinally. The helical spring 16 is indirectly or directly supported at one end against the housing body 4 and at the other end against the impact body 14 such that the impact body 14 is movable linearly and preloadable in a longitudinal direction or along a longitudinal axis 18.

According to the invention, the impact body 14 is not only formed by a mass body used to exert a kinetic impulse on an ignition device of the effect-producing body, but the impact body 14 is, in the example and preferred case shown, sleeve-shaped in portions and simultaneously accommodates an ignition device 20 with an ignition charge 22 and a delay device 24 with a delay charge 26 in its interior. The detonating device 20 and the delay device 24 are therefore part of the impact body 14 and are tensioned and triggered together with said impact body in a manner still to be described below.

Figure 4:
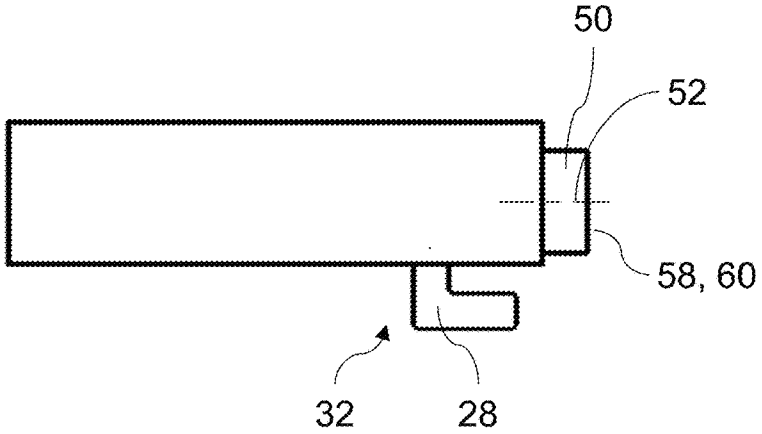
FIG. 4 is a view of the effect-producing body in a direction of arrow IV in FIG. 2.
Figure 3:
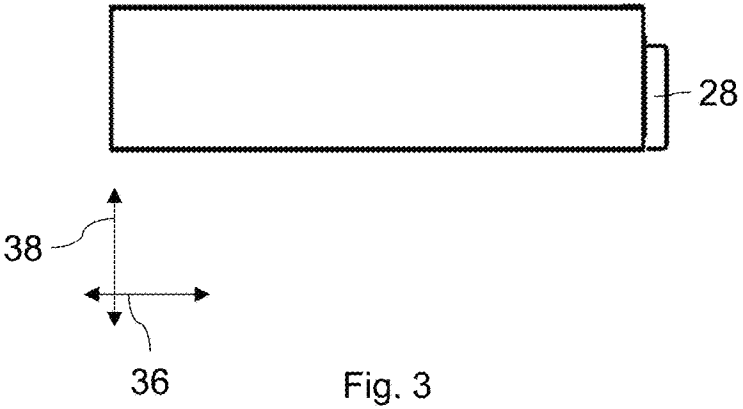
FIG. 3 is a view of the effect-producing body in a direction of arrow III in FIG. 1.

The triggering device 6 further comprises a manually grippable tensioning element 28, which in the example and preferred case shown is pivotally connected to the impact body 14. The tensioning element 28 forms a type of pivot lever and is pivotable between a securing position 30 shown in FIG. 1 and a tensioning position 32 shown in FIGS. 2 and 4. The tensioning element 28 is initially drivingly connected to the impact body 14 with respect to the longitudinal axis 18. For example, it is axially provided on the impact body 14 between two radial projections or ring flanges or drivingly connected in some other way. In order to explain this better is a first direction 34, a second direction 36 and a third direction 38 of the housing body 4, which run orthogonally to one another and are shown in the drawings. The first direction 34 runs in parallel with the longitudinal axis 18. Accordingly, each of the edges of the housing body 4 extend in one of the three directions provided that the housing has the ideal cuboid shape, which understandably does not necessarily have to be the case. However, the housing body 4 shown as preferred and as an example is to be regarded as flat and cuboid insofar as its dimension in the first direction 34 is larger than in the second direction 36 and larger than in the third direction 38. In the case shown as an example, the tensioning element 28 extends outward beyond the housing body 4 in the second direction 36 when in its securing position 30 so that it can be easily touched and actuated, for example with a user's thumb. In this securing position 30, the tensioning element 28 extends outward through a slot 40 in a housing wall 42 (most clearly visible in FIG. 2). It is therefore interlockingly held with respect to the longitudinal direction 18 by flanks of the wall 42 of the housing body 4 which delimit the slot 40. As a result, the impact body 14 is also held or fixed with respect to the longitudinal axis 18. It is clear that in the securing position of the tensioning element 28, a free longitudinal end 44 of the impact body 14 is at a spacing from an axial stop 46, which can also be referred to as an anvil, in the direction of the longitudinal axis 18 within the first receiving space 8. If the tensioning element 28 is pivoted about the longitudinal axis 18 by, in this case, 90° for example, from the securing position 30 shown in FIG. 1 so that it protrudes beyond the housing body 4 in the third direction 38 (as can be seen from FIG. 4), it is located in its tensioning position 32. In this tensioning position 32, the tensioning element 28 and together therewith the impact body 14 are movable counter to the spring force and along the longitudinal axis 18 into the preloaded position 48 of the impact body 14 shown in FIG. 2. This can also be done by means of the thumb of a user's hand holding the cuboid housing body 4.

Figure 1:
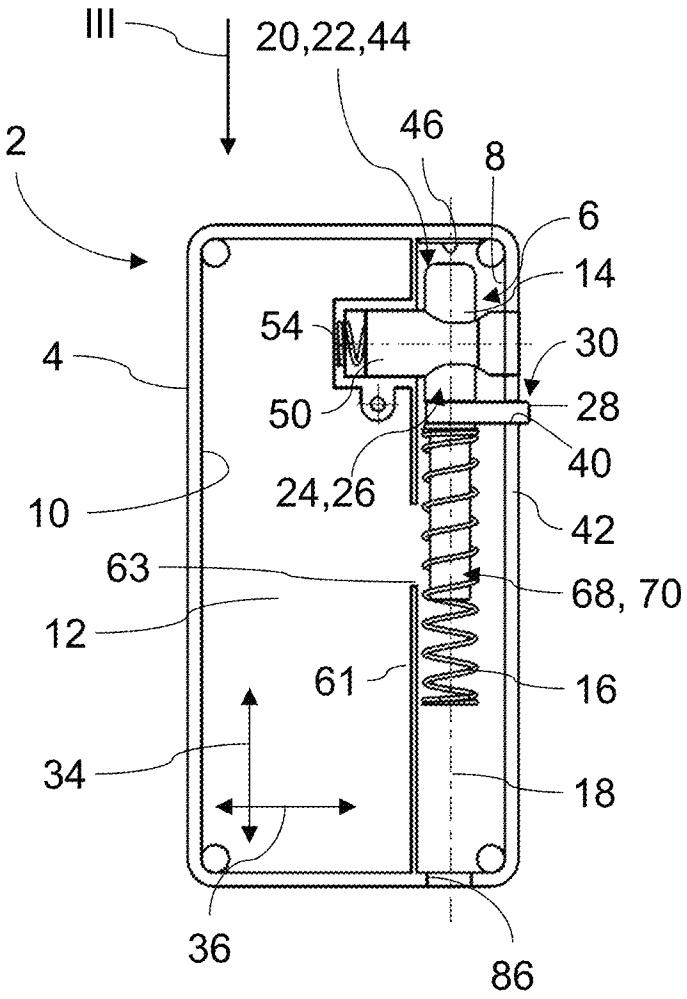
FIG. 1 is a view into the interior of the effect-producing body in an unloaded state of the impact body.

As soon as the tensioning element 28 and together therewith the impact body 14 are moved into the preloaded position 48 shown in FIG. 2, the impact body 14 is automatically releasably arrested in its preloaded position 48. This is achieved by the triggering device 6 further comprising a spring-loaded locking member 50 which is movable back and forth transversely to the longitudinal axis 18, specifically along an axis 52 extending orthogonally to the longitudinal axis 18. By means of a spring element 54, the locking member 50 is preloaded in the direction of the axis 52. It comprises a through-opening 56 which extends along the longitudinal axis 18 so that, as shown in FIG. 1, the impact body 14 can extend through this through-opening 56. If the impact body 14 is now moved by means of the tensioning element 28 from the position shown in FIG. 1 into its preloaded position 48 shown in FIG. 2, the locking member 50 snaps from its position shown in FIG. 1 into the position shown in FIG. 2. The locking member 50 thereby arrives in front of the free longitudinal end 44 of the impact body and supports or secures the impact body 14 in the preloaded position 48 shown in FIG. 2. As can also be seen from FIG. 2, the locking member 50 extends outward through an opening 57 in the wall 42 of the housing body 4 and projects outward beyond the housing body 4 in the second direction 36. An outwardly projecting region or free end 58 of the locking member 50 simultaneously forms a triggering element 60 of the triggering device 6, as can easily be understood from the drawings. If, starting from the preloaded position 48 of the impact body 4 shown in FIG. 2, a user actuates the triggering element 60 by pressing a finger on the free end 58 of the locking member 50, the locking member 50 is moved along the axis 52 back into the position shown in FIG. 1. When this position is reached, the impact body 14 is aligned with the clear cross-sectional area of the through-opening 56 of the locking member 50 and is then suddenly accelerated along the longitudinal axis 18 by relaxing the spring 16. It shoots against the axial stop 46. The associated impulse transfer causes impact initiation, and the ignition device 20 provided immediately adjacently to the free longitudinal end 44 of the impact body 14 in the interior thereof is initiated. Proceeding therefrom, the delay device 24 and its delay charge 26 are initiated. The user must now quickly throw the effect-producing body toward its destination, where the main charge 12 is then initiated proceeding from the burning delay charge.

To make sure this happens, it can be provided that, starting from the end of the delay line, i.e. from the end of the burning delay charge 26, the initiation is directly transferred to the main charge 12 and thus the main charge 12 is initiated. For this purpose, in FIGS. 1 and 2 an opening 63 is formed, for example, in a separator 61 separating the main charge 12 from the triggering device 6 and the delay device 24 in the interior of the housing body 4. However, a plurality of openings 63 can also be formed in the separating separator 61. Furthermore, it is alternatively or additionally conceivable that a pyrotechnic ignition device, for example in the form of a fuse, is provided between the delay device 24 with its delay charge 26 and the main charge 12, which ignition is connected to the end of the delay line and then leads to the main charge 12. It is also conceivable by way of example and indicated as an example in FIGS. 1 and 2 that a initiator 68 with a primary charge and a secondary charge is provided in a sleeve-shaped receptacle 70 between the delay device 24 with its delay charge 26 and the main charge 12, which initiator is connected to the end of the delay line and which, when initiated, then leads to the main charge 12 being set off. The sleeve-shaped receptacle 70 of the initiator 68 is pushed onto the receptacle of the delay device 24, which is likewise sleeve-shaped, and forms the impact body 14 together therewith.

Figure 7:
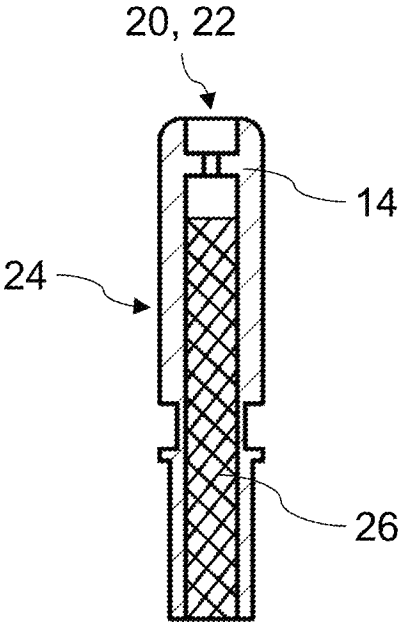
FIG. 7 is a longitudinal sectional view of the delay device.
Figure 9E:
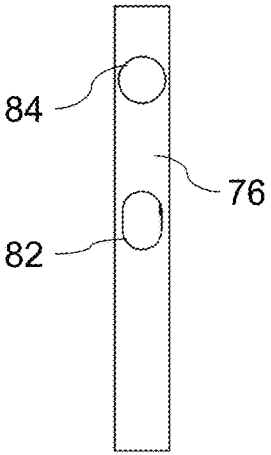
FIGS. 9*a* to 9*f* illustrate different views of the guide housing body.
Figure 9D:
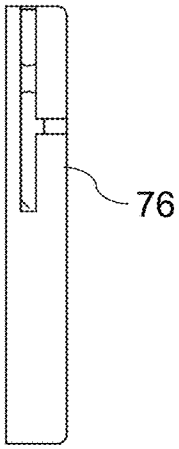
Figure 9B:
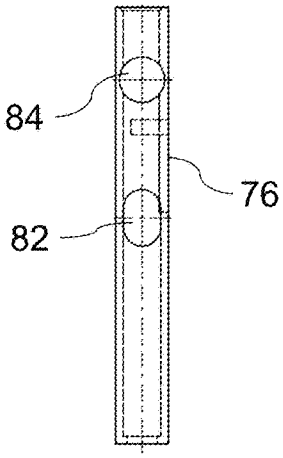
Figure 9A:
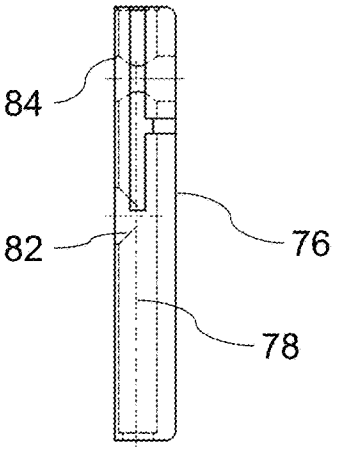
Figure 9F:
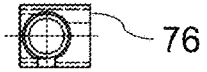
Figure 9C:
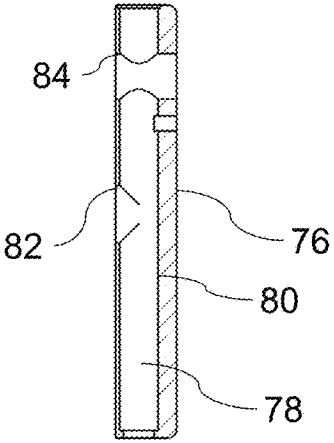

FIG. 7 shows a longitudinal sectional view of the delay device 24 with the ignition device 20 and ignition charge 22, which can be formed as a primer, which is known per se. The longitudinal extension of the delay charge 26 forms the delay line.

Figure 8:
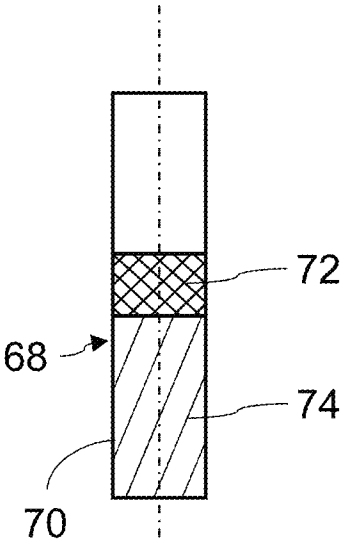
FIG. 8 is a longitudinal sectional view of the detonator.

FIG. 8 shows a longitudinal sectional view of the initiator 68 with a primary charge 72 and secondary charge 74.

With the interposition of the helical spring 16, the impact body 14 together with the ignition charge 22, delay charge 26 and the downstream initiator 68 are accommodated so as to move longitudinally in a prefabricated guide housing body 76 which can be inserted into the housing body 4 and which is shown in various views in FIG. 9*a-f*. The guide housing body 76 comprises an opening 78 that is elongated in the longitudinal direction and has a step 80 against which the helical spring 16 can be axially supported. Furthermore, on the side toward the separator 61, a transverse opening 82 is formed which is aligned with the opening 63 in the separator 61 such that initiation transfer and thus the initiation of the main charge 12 can take place through these openings 82, 63. The transverse openings 84 shown above allow the locking member 50 to pass through. The longitudinal opening 78 opens up at the lower end of the guide housing body 76 where it is aligned with an opening 86 in the housing body 4 (visible in FIGS. 1 and 2) which leads outward. Through these openings 86 and 78, the main charge is initiatable externally, for example, by other electrical or pyrotechnic initiators.

The loaded position 48 of the impact body 14 shown in FIG. 2 can also be reversed, i.e. the impact body 14 can be returned to the unloaded or only slightly preloaded position shown in FIG. 1. To do this, the user must securely hold the tensioning element 28 by hand and then actuate the triggering element 60 in the manner described above until the impact body 14 is again aligned with the through-opening 56 in the locking member 50 and can be moved through the through-opening 56 in the locking member. The tensioning element 28 must then be pivoted back into the locking position 30 shown in FIG. 1, in which it holds the impact body 14 at a safe distance from the axial stop 46. The effect-producing body 2 is now deactivated again.

Furthermore, in this context, but also when tensioning the impact body 14 and the helical spring 16, it has proven to be advantageous if a large enough clamping frictional force occurs between the boundary of the through-opening 56 in the locking member 50 and the outside of the impact body 14, which force can prevent the impact body 14 from shooting against the stop 44 when tensioning or relaxing it if a finger of the user accidentally slips off the tensioning element 28. It is therefore preferable to implement a clamping mechanism here which can reliably prevent this. In this respect, it has also proven to be advantageous if the through-opening 56 is designed to have a slightly larger inner diameter than the outer diameter of the impact body 14. In the event of intentional triggering, this clamping engagement can be suddenly released by manually actuating the triggering element 60.

Figure 6:
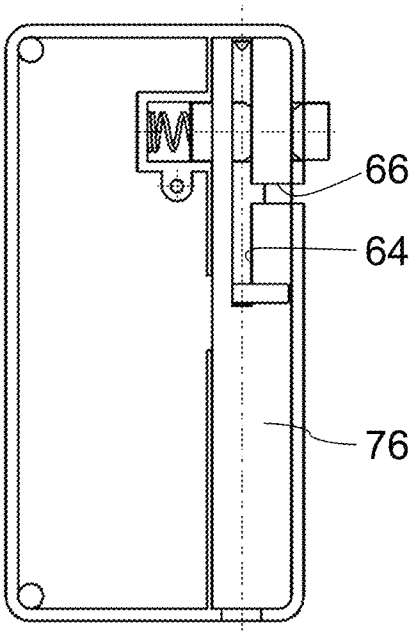
FIG. 6 is a view of an outer housing side of the effect-producing body corresponding to FIG. 2.
Figure 5:
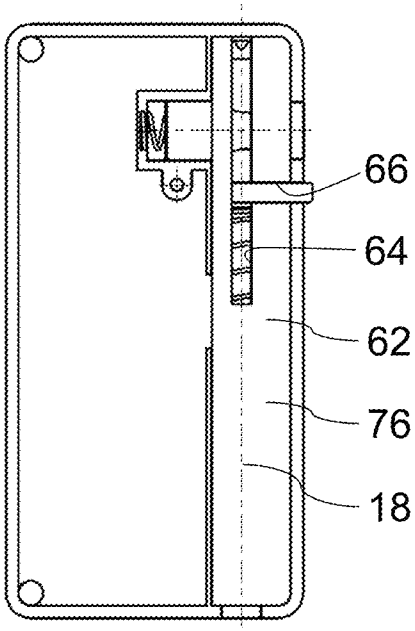
FIG. 5 is a view of an outer housing side of the effect-producing body corresponding to FIG. 1.

Finally, FIGS. 5 and 6 show views corresponding to FIGS. 1 and 2, but of an external visible side of the housing body 4. It can be seen that a longitudinal slot 64 extending in the longitudinal direction 18 and a transverse slot 66 are formed in one side or wall 62 of the housing body 4 such that the tensioning element 28 can be pivoted and longitudinally moved, together with the impact body 14, as described above.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A hand-throwable effect-producing body comprising:

a manually graspable housing body;

a manually operable triggering device with a spring-loaded impact body;

an ignition device that is initiatable by the triggering device, the ignition device comprises an ignition charge;

a delay device that is initiatable by the ignition device, the delay device comprises a delay charge and a delay line; and a main charge that is initiatable directly or indirectly by the delay charge, wherein the impact body comprises the ignition device together with the ignition charge and the delay device together with the delay charge and the delay line, wherein the impact body is manually movable along a longitudinal axis thereof counter to a spring force into a preloaded position and is releasably arrestable there and is releasable by manually operating a triggering element of the triggering device such that the impact body is adapted to shoot out of the preloaded position along the longitudinal axis against an axial stop and thereby initiate the ignition charge, wherein the triggering device comprises a manually grippable tensioning element via which the impact body is movable into the preloaded position, and wherein the manually grippable tensioning element is arranged so as to be pivotable about the longitudinal axis with respect to the housing body and also with respect to the impact body.

2. The hand-throwable effect-producing body according to claim 1, wherein the impact body is sleeve-shaped at least in portions and forms a receiving space for the ignition device and the delay device.

3. The hand-throwable effect-producing body according to claim 1, wherein the impact body is guided within a helical spring along the longitudinal axis such that the impact body is adapted to move longitudinally, and wherein the helical spring is directly or indirectly axially supported at one end with respect to the longitudinal axis against the housing body or is received and supported in a guide housing body insertable into the housing body.

4. The hand-throwable effect-producing body according to claim 3, wherein the helical spring is connected at the other end to the impact body or is supported against the impact body in a direction of the longitudinal axis or is supported against a radial projection of the impact body.

5. The hand-throwable effect-producing body according to claim 1, wherein the manually grippable tensioning element is drivingly connected to the impact body in the direction of the longitudinal axis.

6. The hand-throwable effect-producing body according to claim 1, wherein the manually grippable tensioning element is movable back and forth between a securing position and a tensioning position, and wherein the impact body is held at a distance from the axial stop in the direction of the longitudinal axis when the manually grippable tensioning element is in the securing position, and wherein the impact body is movable back and forth in the direction of the longitudinal axis when the manually grippable tensioning element is in the tensioning position.

7. The hand-throwable effect-producing body according to claim 1, wherein the impact body together with a helical spring is accommodated longitudinally displaceably in a guide housing body, the quide housing body being insertable into the housing body.

8. A method for operating a hand-throwable effect-producing body according to claim 1, the method comprising:

providing the manually operable triggering device with the impact body, which is spring-loaded along the longitudinal axis, the ignition device that is initiatable by the triggering device and comprises the ignition charge, the delay device, which is initiatable by the ignition device and comprises the delay charge and the delay line, and the main charge that is initiatable directly or indirectly by the delay charge;

moving or pivoting a tensioning element, that is drivingly coupled to the impact body, from a securing position, in which the impact body is releasably held counter to the spring force, into a tensioning position;

moving, when the tensioning element is in the tensioning position, the tensioning element together with the impact body along the longitudinal axis of the impact body counter to the spring force into the preloaded position;

releasably arresting the impact body in the preloaded position; and releasing the arrest of the impact body by manually operating the triggering element of the triggering device, such that the impact body shoots out of the preloaded position along the longitudinal axis against the axial stop and thereby initiates the ignition charge, wherein the triggering device comprises the manually grippable tensioning element via which the impact body is movable into the preloaded position, and wherein the manually grippable tensioning element is arranged so as to be pivotable about the longitudinal axis with respect to the housing body and also with respect to the impact body.

9. The method according to claim 8, wherein, in order to releasably arrest the impact body in the preloaded position, a spring-loaded locking member is automatically moved into a position that locks the impact body along the longitudinal axis when the impact body is tensioned.

10. The method according to claim 9, wherein the spring-loaded locking member protrudes from the housing body in the position that locks the impact body and is pressed back into the housing body as a triggering element in order to release the impact body.

11. A hand-throwable effect-producing body comprising:

a manually graspable housing body:

a manually operable triggering device with a spring-loaded impact body;

an ignition device that is initiatable by the triggering device, the ignition device comprises an ignition charge;

a delay device that is initiatable by the ignition device, the delay device comprises a delay charge and a delay line; and a main charge that is initiatable directly or indirectly by the delay charge, wherein the impact body comprises the ignition device together with the ignition charge and the delay device together with the delay charge and the delay line, wherein the impact body is manually movable along a longitudinal axis thereof counter to a spring force into a preloaded position and is releasably arrestable there and is releasable by manually operating a triggering element of the triggering device such that the impact body is adapted to shoot out of the preloaded position along the longitudinal axis against an axial stop and thereby initiate the ignition charge, wherein the impact body is releasably lockable in the preloaded position by a spring-loaded locking member interlockingly engaging behind the impact body in the direction of the longitudinal axis, and wherein the spring-loaded locking member is movable linearly back and forth transversely to the longitudinal axis.

12. The hand-throwable effect-producing body according to claim 11, wherein the spring-loaded locking member has a through-opening extending in the direction of the longitudinal axis, through which the impact body is movable when the spring-loaded locking member is in a position in which the through-opening of the spring-loaded locking member is aligned with the longitudinal axis of the impact body.

13. The hand-throwable effect-producing body according to claim 11, wherein the spring-loaded locking member is shaped as a piston, rod or shaft portion and is accommodated in the housing body so as to be movable transversely to the longitudinal axis.

14. The hand-throwable effect-producing body according to claim 12, wherein the spring-loaded locking member has a constriction around an outer circumference that forms an insertion bevel for the impact body in the direction of the through-opening.

15. The hand-throwable effect-producing body according to claim 11, wherein the triggering element of the triggering device also forms the spring-loaded locking member.

16. The hand-throwable effect-producing body according to claim 11, wherein the spring-loaded locking member projects outward beyond the housing body with a free end when the spring-loaded locking member is in a position in which the spring-loaded locking member locks the impact body in the preloaded position.

17. The hand-throwable effect-producing body according to claim 11, wherein the spring-loaded locking member is spring-loaded by a spring that extends transversely to the longitudinal axis.

18. A hand-throwable effect-producing body comprising:

a manually graspable housing body;

a manually operable triggering device with a spring-loaded impact body;

an ignition device that is initiatable by the triggering device, the ignition device comprises an ignition charge;

a delay device that is initiatable by the ignition device, the delay device comprises a delay charge and a delay line; and a main charge that is initiatable directly or indirectly by the delay charge, wherein the impact body comprises the ignition device together with the ignition charge and the delay device together with the delay charge and the delay line, wherein the impact body is manually movable along a longitudinal axis thereof counter to a spring force into a preloaded position and is releasably arrestable there and is releasable by manually operating a triggering element of the triggering device such that the impact body is adapted to shoot out of the preloaded position along the longitudinal axis against an axial stop and thereby initiate the ignition charge, and wherein the housing body is substantially cuboid and flat and comprises a first direction and a second direction and a third direction which are orthogonal to one another and extend along or in parallel with corresponding edges of the housing body, the first direction running along the longitudinal axis of the impact body, and the dimension of the housing body being larger in the first direction than in the second and third directions, and wherein the housing body delimits a first and a second receiving space, both of which extend in the first direction and are arranged next to one another in the second direction, and wherein the triggering device with the ignition device and the delay device are accommodated in the first receiving space, and wherein the main charge is accommodated in the second receiving space.

19. The hand-throwable effect-producing body according to claim 18, wherein the first and the second receiving space are separated from one another by a wall extending in the first direction, and wherein the wall is thin or has openings so that the overignition is transferable from the delay charge to the main charge through the wall.

20. The hand-throwable effect-producing body according to claim 18, wherein a manually grippable tensioning element projects outward in the second direction beyond the housing body when in a securing position.

21. The hand-throwable effect-producing body according to claim 20, wherein the manually grippable tensioning element is pivotable from the securing position into a tensioning position and projects outward beyond the housing body or in the third direction when in the tensioning position.

22. The hand-throwable effect-producing body according to claim 18, wherein a spring-loaded locking member projects outward beyond the housing body in the second direction when in a position in which the spring-loaded locking member locks the impact body in the preloaded position.

* * * * *